United States Patent [19]

Elhaus

[11] Patent Number: 4,541,799

[45] Date of Patent: Sep. 17, 1985

[54] PREHEATING FURNACE FOR ELONGATED MATERIAL

[76] Inventor: Friedrich W. Elhaus, Dorfstr. 21, 7761 Moos, Fed. Rep. of Germany

[21] Appl. No.: 548,861

[22] PCT Filed: Feb. 1, 1983

[86] PCT No.: PCT/EP83/00022

§ 371 Date: Sep. 21, 1983

§ 102(e) Date: Sep. 21, 1983

[87] PCT Pub. No.: WO83/02661

PCT Pub. Date: Aug. 4, 1983

[30] Foreign Application Priority Data

Feb. 2, 1982 [DE] Fed. Rep. of Germany ..... 3203433

[51] Int. Cl.[4] ..... F27D 17/00; F27D 1/00

[52] U.S. Cl. ..... 432/177; 432/178; 432/247

[58] Field of Search ..... 432/93, 128, 133, 177, 432/178, 247

[56] References Cited

U.S. PATENT DOCUMENTS

| | | | |
|---|---|---|---|
| 1,378,710 | 5/1921 | Meyerhofer | 432/247 |
| 2,603,470 | 7/1952 | Hess | 432/133 |
| 3,273,218 | 9/1966 | Byington | 432/133 |

FOREIGN PATENT DOCUMENTS

| | | | |
|---|---|---|---|
| 2637646 | 2/1978 | Fed. Rep. of Germany . | |
| 2354524 | 10/1978 | France | 432/247 |

*Primary Examiner*—John J. Camby

*Attorney, Agent, or Firm*—Willian Brinks Olds Hofer Gilson & Lione Ltd.

[57] ABSTRACT

A preheating furnace for elongated material, particularly bars, billets, and the like of light metal has a furnace tunnel (15) formed by furnace shells (14) for preheating the material (1). At least in their central range the furnace shells are covered by a heat insulation which comprises removably designed insulation members (54,56). The insulation members (54,56) are drawn upwardly above the furnace shells (14) forming an exhaust gas duct (32) in which the furnace tunnel is integrated. Thus a heat insulation for the preheating furnace is provided which is easy to assemble and disassemble and considerably improves the utilization of the heat energy.

8 Claims, 4 Drawing Figures

46
43
45
33
42
44
1
13
12
12

PREHEATING FURNACE FOR ELONGATED MATERIAL

The invention relates to a preheating furnace for elongated material, like bars, ingots, billets, and the like of metal, particularly aluminum or aluminum alloys, comprising a furnace tunnel made of continuous or segmentally joined refractory furnace shells, particularly thin-walled furnace shells, and adapted to be heated by heater elements, like burners, hot gas nozzles, and the like which extend through the shell walls and are directed toward the material introduced in longitudinal orientation in the furnace tunnel for direct heating of the same, and further comprising an exhaust gas duct disposed in the upper furnace range.

In a known furnace of this kind (DE-PS No. 1807504 which corresponds to U.S. Pat. No. 3,632,093) the thin-walled furnace shells are inserted in the furnace structure without heat insulation. This causes heat losses especially by radiation from the outside walls of the furnace shells. The exhaust gas is sucked off into the exhaust gas duct through a slot in the top of the furnace tunnel. In the path of the gas between the furnace tunnel and the exhaust gas duct heat gets lost. For this reason the efficiency of the known furnace is low. Besides, the known structure is complicated and high because the exhaust gas duct is arranged separately above the furnace tunnel.

It is the object of the invention to design a preheating furnace of the kind specified initially such that the energy supplied for heating is utilized more effectively with a simple and compact structure.

To meet this object it is provided, in accordance with the invention, in a preheating furnace of the kind specified initially that the furnace tunnel is integrated in the exhaust duct which comprises a heat insulation. Preferably the heat insulation of the exhaust gas duct covers the furnace shells of the furnace tunnel from outside at least in their central range so that the lower areas of the furnace shells remain free for purposes of assembly and maintenance.

The fact that the invention provides for much better utilization of the energy is due to the circumstance that the exhaust gas is transferred from the furnace tunnel into the exhaust gas duct without any heat losses, for instance through the upper gap between the vertically disposed furnace shell halves. By virtue of the design in accordance with the invention the central and upper portions of the furnace tunnel are sufficiently well thermally insulated by the exhaust gas duct itself, i.e. without any additional measures. Heat insulation of the lower areas of the furnace tunnel has been dispensed with on purpose to provide better accessibility for assembly work and maintenance. The inventor found out that the losses by heat radiation in the lower areas of the furnace shells are relatively small. Leaving out a heat insulation in these lower areas is highly advantageous because there remains space for the reception and accessibility of aggregates, like burners, supporting frame for the furnace shells, and the conveyor means for the material to be preheated.

The insulation members may extend vertically upwardly from the support members or they may adapt to the upper areas of the furnace shells.

A further development of the invention which is particularly advantageous as regards simple assembly and disassembly, is characterized in that heat insulation is supported by support members mounted stationarily on a support frame of the furnace and comprises removable insulation members disposed above the same, the lower members thereof affording lateral support and insulation of the furnace shells. According to a preferred embodiment of the invention with which lower and upper burner rows are provided, distributed around the circumference of the furnace tunnel, it is provided that the burners of the upper burner rows extend through removable insulation members, while the burners of the lower burner rows are located in the lower range of the furnace shells which is not heat insulated, and that each insulation member through which burners pass has the same length as corresponding segments of the furnace shells.

If lower burner rows alone are required, another further development of the invention provides for all burner rows to open into the furnace tunnel below the heat insulation, and the exhaust gas duct to be a removable assembly unit. This design is especially favorable as regards simple assembly, maintenance, or exchange of the furnace shells since the exhaust gas duct may be removed as a whole so that the or individual furnace shells may be replaced easily.

With more modern preheating furnaces of the type described the hot exhaust gas is passed from the exhaust gas duct into a preheatng zone of the preheating furnace or another furnace for preheating the material (DE-OS No. 2637646 which corresponds to U.S. Pat. No. 4,153,236) whereby especially economic fuel exploitation is guaranteed. In this context a furnace group is advantageous with which the exhaust gases of the preheating furnace serve to heat an upstream preheating furnace which passes the exhaust gas through at least one fan to at least one row of slot type nozzles arranged along the material and directing the exhaust gas at the material.

The design according to the invention is particularly advantageous where the furnace space of the preheating furnace is divided into several heating and control zones which communicate through a common exhaust gas duct. If individual zones are turned off as the rated temperature is reached, they are not influenced by the other zones in spite of the connection through the exhaust gas duct. The flue gases simply flow out in longitudinal direction in the upper part of the common exhaust gas duct, with preference into a preheating zone or for preheating the material in an upstream preheating furnace for optimum exploitation of the heat capacity of the fuel in this manner in a furnace group consisting of the preheating furnace and further heating furnaces connected in series downstream thereof.

The invention will be described further, by way of example, with reference to cross sections of two preheating furnaces actually constructed.

Figure 1:
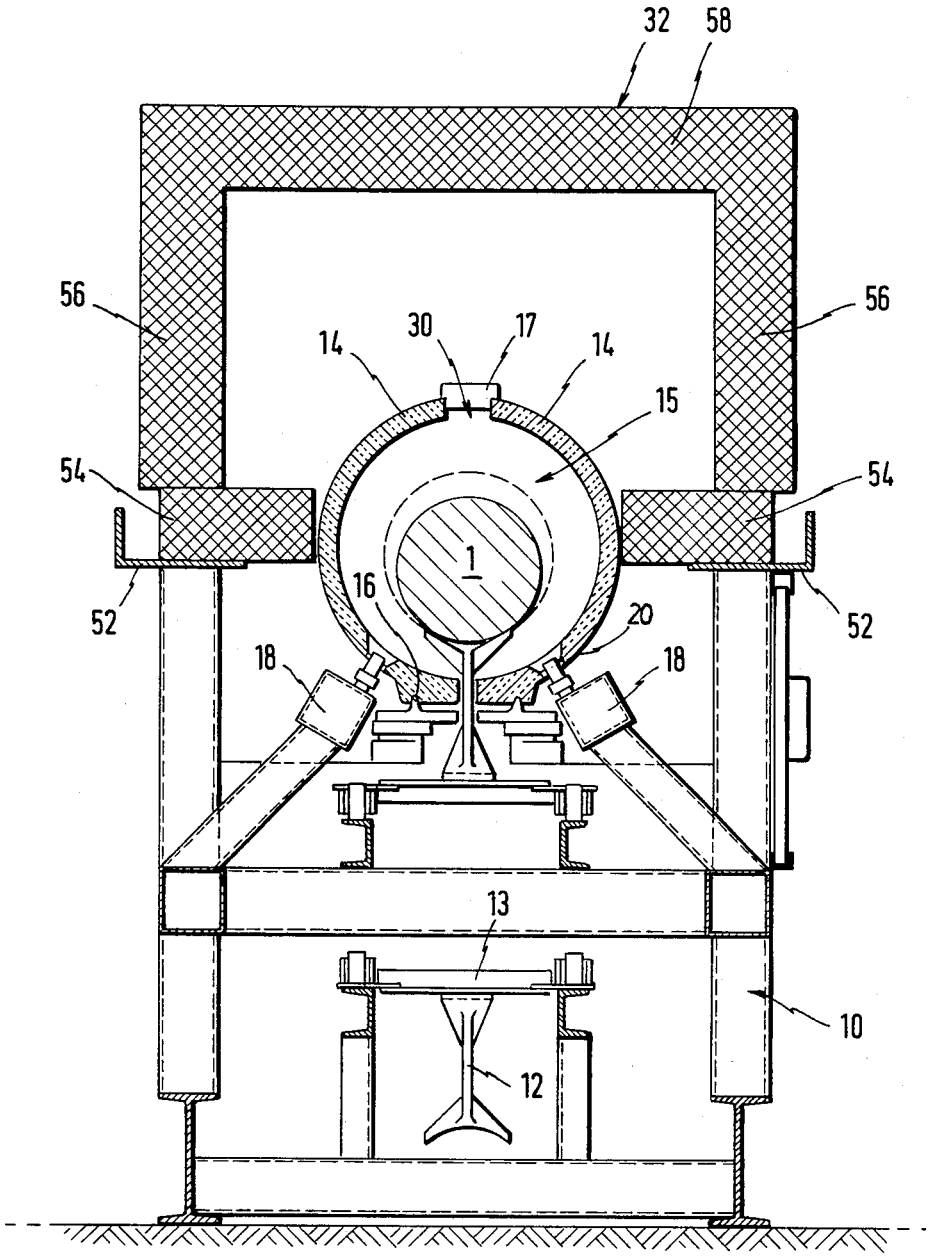
FIG. 1 is a cross section along line I—I of FIG. 3 through a first embodiment of a preheating furnace according to the invention.

The preheating furnaces shown comprise a steel structure support frame 10.

In the lower furnace space there is a double strand conveyor chain 13 to which carrier devices 12 are attached for the material to be preheated, like bars or billets and which advances the material intermittently through the cylindrical furnace tunnel 15 formed by semicylindrical furnace shell halves 14. In their lower range the furnace shells 14 are supported pivotably on carrier rails 16 and held in position from above by spacers 17.

With the embodiment shown in FIG. 1 only one burner row including premixture burners 18 disposed in longitudinal rows vertically of the plane of the drawing is provided per row of furnace shells 14. The burners 18 have burner nozzles 20 which project through openings 21 in the furnace shells into the cylindrical furnace tunnel 15 acting directly on the material. The burners 18 are so arranged that when preheating material 1 of different diameters, the surface is utilized well for heat transfer and the temperature is distributed in rotational symmetry across the cross section of the material. The burner nozzles 20 are adjusted to perform such that the desired temperature distribution is obtained.

Instead of burners 18 hot gas nozzles may be provided for heating, acting on the material 1 for instance by hot air which can be heated electrically in known manner.

The exhaust gases leave the furnace space 15 in upward direction through a longitudinal slot 30 defined by the furnace shell halves 14 at the spacers 17 and then reach an exhaust gas duct 32 directly through a vertical channel. From the exhaust gas duct the exhaust gas is delivered into a preheating zone, not shown, for the material 1 and located upstream of the preheating furnace, for example by being sucked by means of fans, not shown. The exhaust gas duct includes a heat insulation, the lower insulation members 54 of which extend throughout the furnace length, leaving a gap for the furnace tunnel 15, and abutting from outside against the central areas of the furnace shells 14. The lower insulation members 54 are supported by carrier beams 52 which are mounted stationarily on the support frame 10. The principal or top portion of the exhaust gas duct 32 is defined by two vertical insulation members 56 and an upper insulation member 58 integral with them.

With the embodiment according to FIG. 1 the insulation members 56, 58 of the upper part also extend throughout the furnace length. Thus the main portion 56, 58 may be removed as a whole. The furnace shells 14 continue to be held laterally by the lower insulation members 54, yet upon removal of the spacers 17 they may be removed individually for replacement by easy inward pivoting about the respective fulcrum at the carrier rails 16.

The heat insulation comprises two layers for example, the inner one consisting of ceramic fibers which are good heat insulators but bad for storing heat, while the outer one located in an area of lower temperatures is made of mineral fibers.

Figure 2:
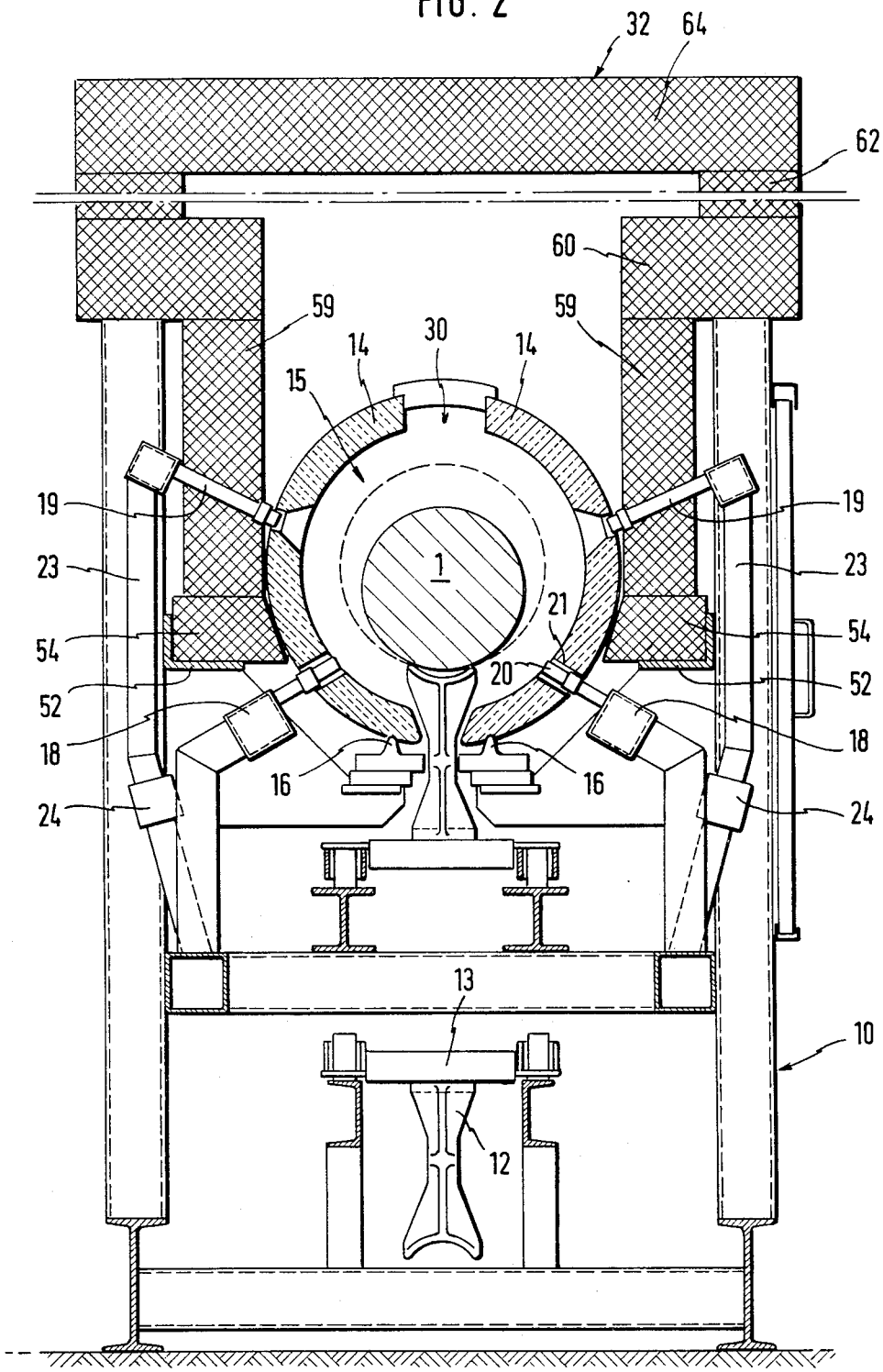
FIG. 2 is a cross section at the same location through a second embodiment.

The embodiment shown in FIG. 2 differs from the one according to FIG. 1 only in that in addition to the lower burner row 18 an upper burner row 19 is provided per furnace shell row. An adjustable throttle valve 24 is arranged in the fuel supply line 23 for adjustment of the upper burners with respect to the lower burners.

The additional upper burner rows necessitate the positioning of vertical insulation members 59, divided into segments in correspondence with the furnace shells 14, between the lower insulation members 54 extending throughout the furnace length and the principal or top portion of the exhaust gas duct 32 whose insulation members 60, 62, 64 again form a united piece which is removable uniformly as a whole. For exchange of furnace shells, the piece 60, 62, 64 must be lifted off. Then the corresponding insulation members 59 must be removed so that upon removal of the spacers 17 the associated furnace shells 14 can be exchanged, as with the embodiment shown in FIG. 1. The somewhat more complicated structure as compared to FIG. 1 is the price for the better uniformity of soaking of the material achieved.

Figure 3:
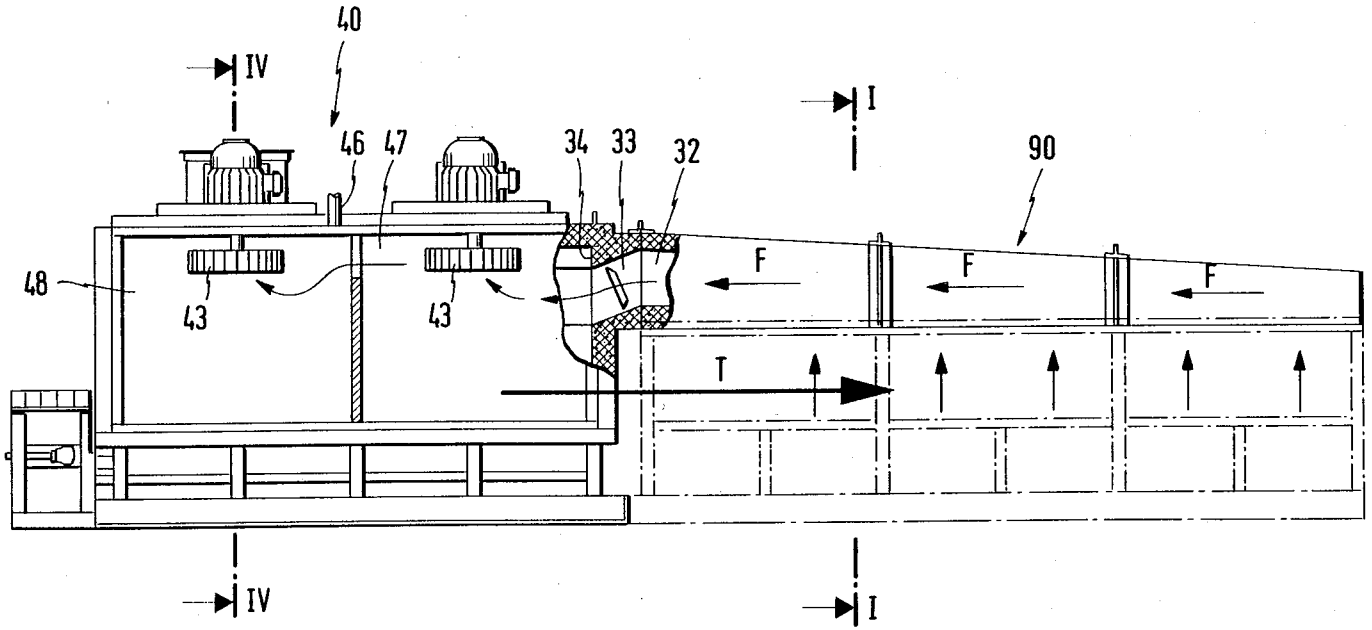
FIG. 3 is a lateral elevation, partly in section, of a furnace group consisting of a preheating furnace and an upstream heating furnace in accordance with a modification of the invention.

The right half of FIG. 3 shows a lateral elevation of a preheating furnace according to FIGS. 1 or 2, here designated 90, whereas the left half shows an upstream preheating furnace which is heated by the exhaust gases from said preheating furnace. To this end the exhaust gas duct 32 opens by an aperture 33 in the right end surface 34, as seen in FIG. 3, of the preheating furnace designated, in general, by reference numeral 40 and illustrated in greater detail in FIG. 4. In the furnace space 41 which communicates with the exhaust gas duct 32 through the aperture 33 and is protected by a heat insulation 42 similar to that of the preheating furnace 90 there are several circulation zones one behind the other, for example two circulation zones 47, 48 each including a fan 43 sucking the exhaust gas in the direction of the arrows F in FIG. 3 out of the exhaust gas duct 32 into the furnace space 41 and then directing it through two rows of slot type nozzles 44 on to the material 1, the nozzles being arranged at both sides so as to converge toward the material 1. The material 1 is fed in conveying direction T through treatment spaces 45 of each circulation zone 47, 48 by means of the double strand conveyor chain 13 which passes through both furnaces 40, 90. Subsequently the exhaust gas is sucked out of the treatment spaces 45 by means of the fans 43 and recirculated or discharged through an outlet 46.

Figure 4:
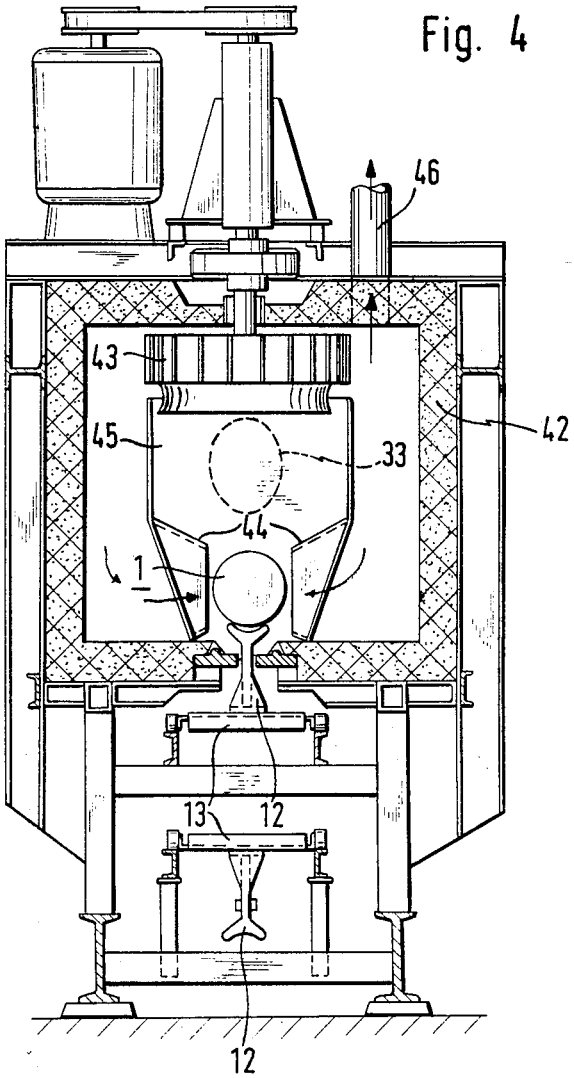
FIG. 4 is a section along line IV—IV of FIG. 3 through a heating furnace of the furnace group connected upstream of a preheating furnace according to FIG. 1 or 2.

In the circulation zones 47, 48 succeeding each other from right to left in FIG. 3 temperatures are established which decrease in a direction opposite to the conveying direction T. Controllable admission in each circulation zone results from this cascade-like exhaust gas guidance, and the heat capacity of the exhaust gas is utilized in optimum fashion. Thus the furnace group according to FIGS. 3 and 4 is characterized by particular economy, i.e. especially low fuel consumption.

What is claimed is:

1. In a preheating furnace for elongated material, like bars, ingots, billets, and the like of metal, particularly aluminum or aluminum alloys, having a furnace tunnel made of continuous or segmentally joined refractory furnace shells, particularly thin-walled furnace shells, and adapted to be heated by heater elements, like burners, hot gas nozzles, and the like which extend through the walls of the furnace shells and are directed toward the material introduced in longitudinal orientation in the furnace tunnel for direct heating of the same, and further having an exhaust gas duct disposed in the upper range of the furnace, the improvement comprising that the furnace tunnel is at least partly enclosed by the exhaust gas duct thereby providing a heat insulation for the furnace tunnel.

2. The preheating furnace as claimed in claim 1, wherein the heat insulation of the exhaust gas duct covers the furnace shells of the furnace tunnel from outside at least in the central range of the furnace.

3. The preheating furnace as claimed in claim 1, further comprising support members mounted stationarily on a support frame of the furnace for supporting the heat insulation and wherein the heat insulation comprises removable insulation members disposed above the support members, the lower members thereof affording lateral support and insulation of the furnace shells.

4. The preheating furnace as claimed in claim 3, wherein the lower insulating members resting on the support members are designed and mountable separately from the other insulation members defining the exhaust gas duct.

5. The preheating furnace as claimed in claim 3 with which lower and upper burner rows are provided, distributed around the circumference of the furnace tunnel, wherein the burners of the upper burner rows extend through removable insulation members, while the burners of the lower burner rows are provided in the lower range of the furnace shells which is not heat insulated, and wherein each insulation member through which burners pass has the same length as corresponding segments of the furnace shells.

6. The preheating furnace as claimed in claim 1, wherein all burner rows open into the furnace tunnel below the heat insulation, and wherein the exhaust gas duct is designed as a removable assembly unit.

7. The preheating furnace as claimed in claim 1 wherein the heat insulation comprises at least one layer of ceramic fibers at the inside and at least one layer of mineral fibers at the outside.

8. In a furnace group having a preheating furnace in which the exhaust gases of the preheating furnace heat an upstream preheating furnace which passes the exhaust gas through at least one fan to at least one row of slot type nozzles of the upstream preheating furnace arranged along the material and directing the exhaust gas at the material, the improvement wherein the exhaust gas duct at least partly encloses a furnace tunnel of the preheating furnace thereby providing heat insulation for the furnace tunnel and wherein the exhaust gas duct is arranged to be essentially aligned with a furnace space of the upstream preheating furnace having a front end and a rear end which furnace space contains the fan and is likewise protected by a heat insulation, such that said exhaust gas duct opens into said furnace space at the front end thereof.

* * * * *